US011439891B2

(12) United States Patent
Ritenour

(10) Patent No.: US 11,439,891 B2
(45) Date of Patent: Sep. 13, 2022

(54) BILLIARDS PRACTICE DEVICE

(71) Applicant: Thomas Ritenour, West Allis, WI (US)

(72) Inventor: Thomas Ritenour, West Allis, WI (US)

(73) Assignee: Thomas Ritenour, West Allis, WI (US)

( * ) Notice: Subject to any disclaimer, the term of this patent is extended or adjusted under 35 U.S.C. 154(b) by 2 days.

(21) Appl. No.: 17/014,505

(22) Filed: Sep. 8, 2020

(65) Prior Publication Data

US 2021/0086061 A1 Mar. 25, 2021

Related U.S. Application Data

(60) Provisional application No. 62/902,548, filed on Sep. 19, 2019.

(51) Int. Cl.
*A63D 15/00* (2006.01)

(52) U.S. Cl.
CPC ..... *A63D 15/006* (2013.01); *A63B 2243/002* (2013.01)

(58) Field of Classification Search
CPC . A63D 15/006; A63D 15/00; A63B 2243/002
USPC ..... 473/1, 22–25
See application file for complete search history.

(56) References Cited

U.S. PATENT DOCUMENTS 297,031 A * 4/1884 Tea ..... A63D 15/00 473/4
301,641 A * 7/1884 Tea ..... A63D 15/00 211/15
884,699 A * 4/1908 Yewell ..... A63D 15/00 211/15
1,557,868 A * 10/1925 Noah ..... A63D 15/00 211/15
3,220,122 A * 11/1965 Miller ..... A63D 15/006 434/247
5,431,398 A * 7/1995 Simpkins ..... A63D 15/00 473/2
2021/0086061 A1* 3/2021 Ritenour ..... A63D 15/006 473/1

* cited by examiner

*Primary Examiner* — Mitra Aryanpour
(74) *Attorney, Agent, or Firm* — Boyle Fredrickson, SC

(57) ABSTRACT

A ball dispensing device for selectively dispensing and/or replacing pool or billiard balls enables an individual to quickly and repeatedly position balls for taking a shot. The device includes a track on which a number of pool balls are positioned and a dispensing or releasing mechanism disposed adjacent the track. The track feed the balls thereon towards the mechanism, such as under the influence of gravity, and the mechanism enables the balls to be dispensed individually from the track onto the table surface. Depending on the number of balls positioned on the track, the device enables an individual to quickly and readily position each of the balls from the track to quickly take a number of the shots as desired utilizing the balls.

4 Claims, 12 Drawing Sheets

BILLIARDS PRACTICE DEVICE

CROSS-REFERENCE TO RELATED APPLICATIONS

The present application claims priority from U.S. Provisional Patent Application Ser. No. 62/902,548, filed on Sep. 19, 2019, the entirety of which is expressly incorporated herein by reference for all purposes.

FIELD OF THE DISCLOSURE

The present disclosure relates generally to billiards, and more specifically to accessories for practicing billiards.

BACKGROUND OF THE DISCLOSURE

In billiards or pool, in order to practice selected shots in preparation for competition, it is necessary for an individual to manually position the billiard or pool balls where necessary in order to stage the desired shot to be taken. In order to enable an individual to take a number of the practice shots desired, after the first shot has been taken and the staged balls are spread over the billiard or pool table surface and in the pockets, the individual must manually retrieve and replace each ball in the proper location to take the next practice shot. Further, to repetitively practice the type of shot desired, the individual must continually retrieve and replace the balls in the proper locations for the shot each time it is desired to take the practice shot.

This continuous process of setting up the balls where necessary for the shot, taking the shot, retrieving the balls and resetting the balls for the next shot takes a significant amount of time and energy, thereby greatly diminishing the amount of worthwhile practice that can be performed in a given amount of time.

Therefore, it is desirable to develop a device for replacing the balls for taking a billiards or pool shot in a manner that greatly reduces the time and energy required to rest the desired shot.

Therefore, it is desirable to develop a device for replacing the balls for taking a billiards or pool shot in a manner that greatly reduces the time required to rest the desired shot.

SUMMARY OF THE DISCLOSURE

According to one aspect of an exemplary embodiment of the invention, a device for selectively dispensing and/or replacing pool or billiard balls enables an individual to quickly and repeatedly position balls for repetitively setting up and taking a practice shot. The device includes a track on which a number of pool balls are positioned and a dispensing or releasing mechanism disposed adjacent the track. The track feeds the balls thereon towards the mechanism, such as under the influence of gravity, and the operation of the mechanism enables the balls to be dispensed individually from the track. Depending on the number of balls positioned on the track, the device enables an individual to quickly dispense and readily position each of the balls from the track to quickly take a number of the shots as desired utilizing the balls.

According to another aspect of an exemplary embodiment of the invention, the device includes a flat lower surface that contact the billiards or pool table top in order to enable the device to be readily positioned on the table top for use in dispensing the balls. The flat lower surface also enables the device to be easily moved over the table top in order to position the device in a location that dispenses the balls where desired to set up successive practice shots.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE DRAWINGS

Before the present compositions, apparatuses and methods are described, it is understood that this invention is not limited to the particular embodiments and methodology, as these may vary. It is also to be understood that the terminology used herein is for the purpose of describing particular exemplary embodiments only, and is not intended to limit the scope of the present invention which will be limited only by the appended claims.

With reference now to FIGS. 1-5 an exemplary embodiment of a billiard ball dispensing device is illustrated generally at 10. The device 10 includes a track 12 and a dispensing mechanism 14 attached to the track 12.

Figure 1:
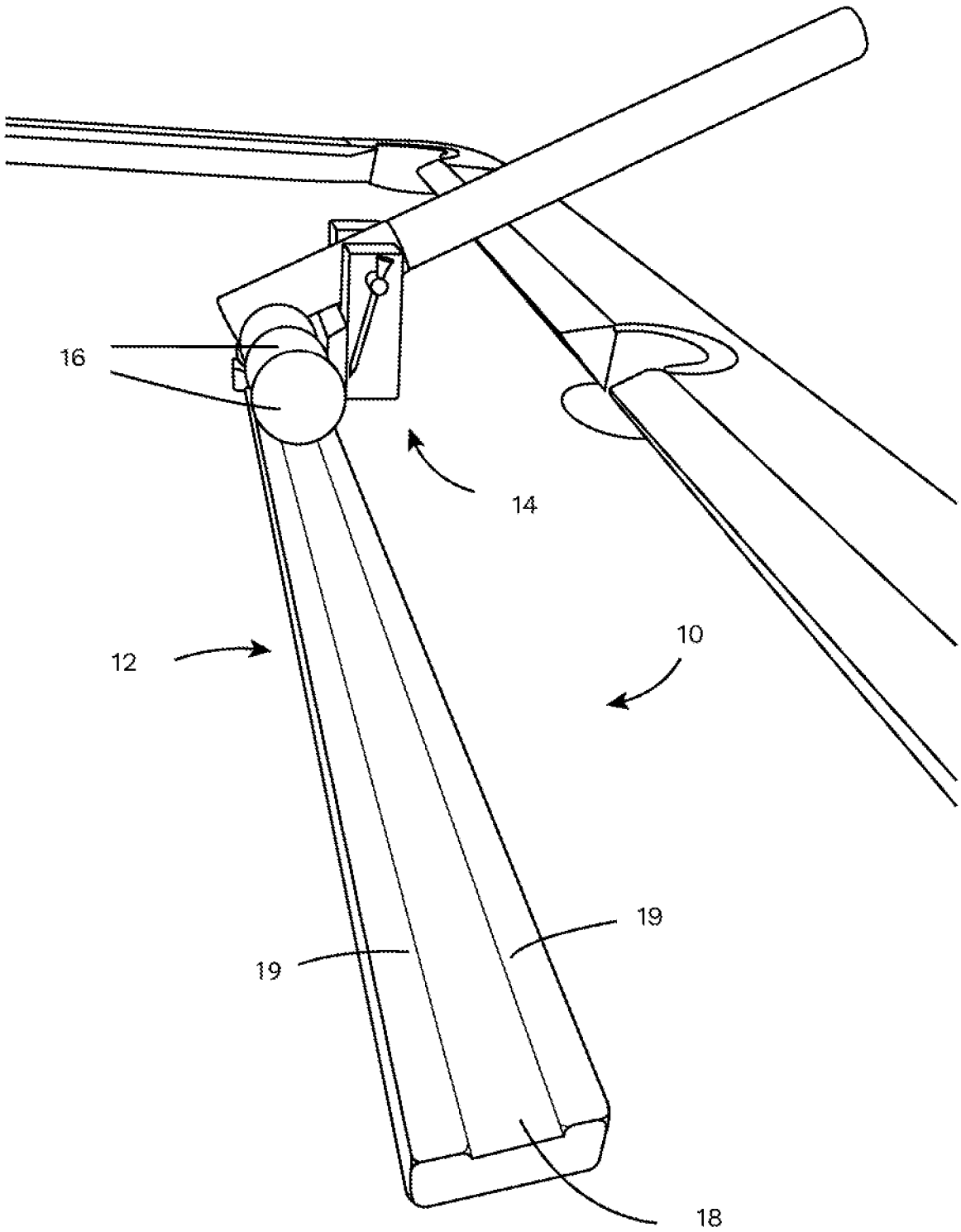
FIG. 1 is a rear perspective view of a billiard ball dispensing device according to an exemplary embodiment the invention.
Figure 2:
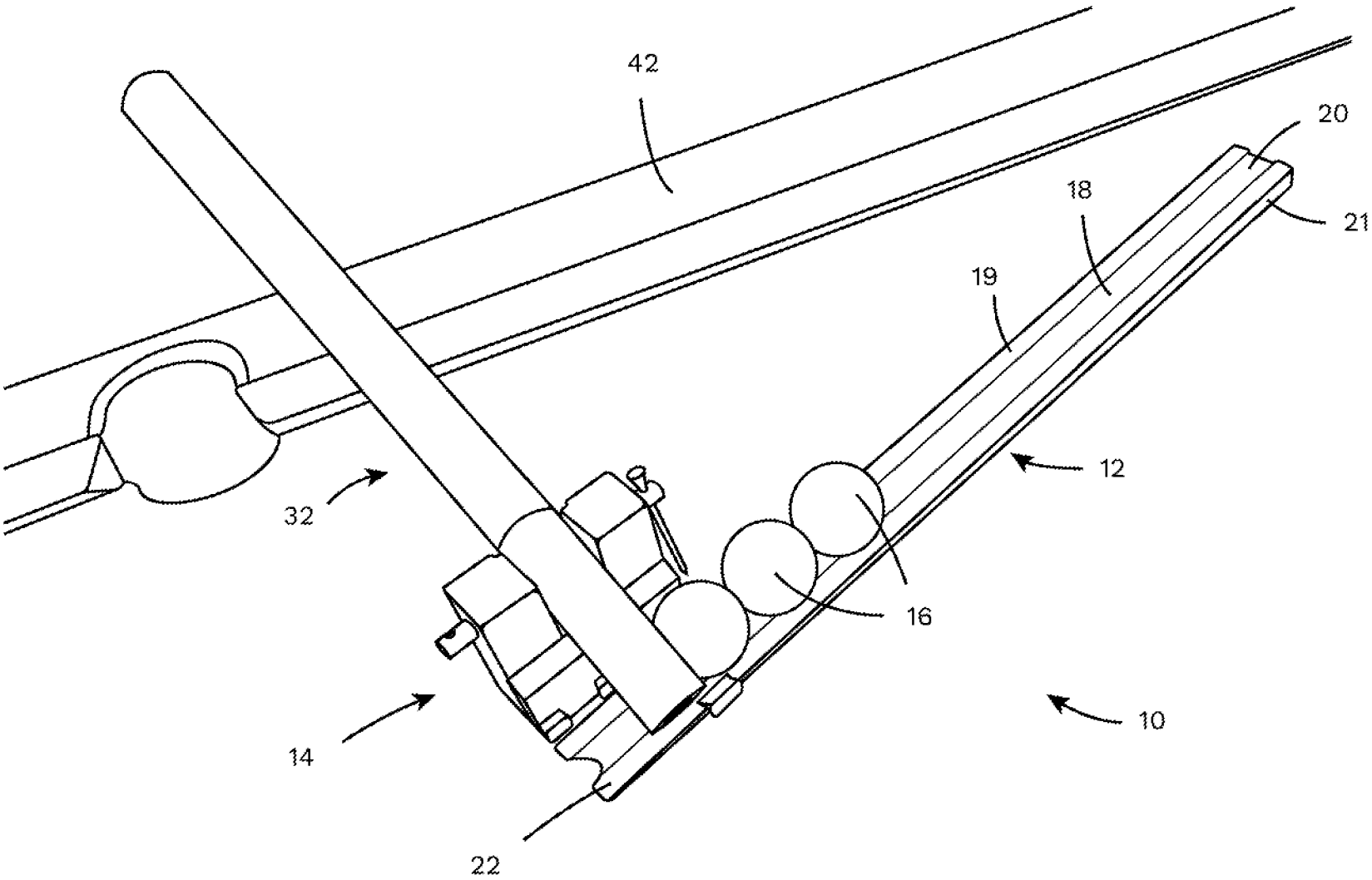
FIG. 2 is a top perspective view of the dispensing device of FIG. 1.
Figure 3:
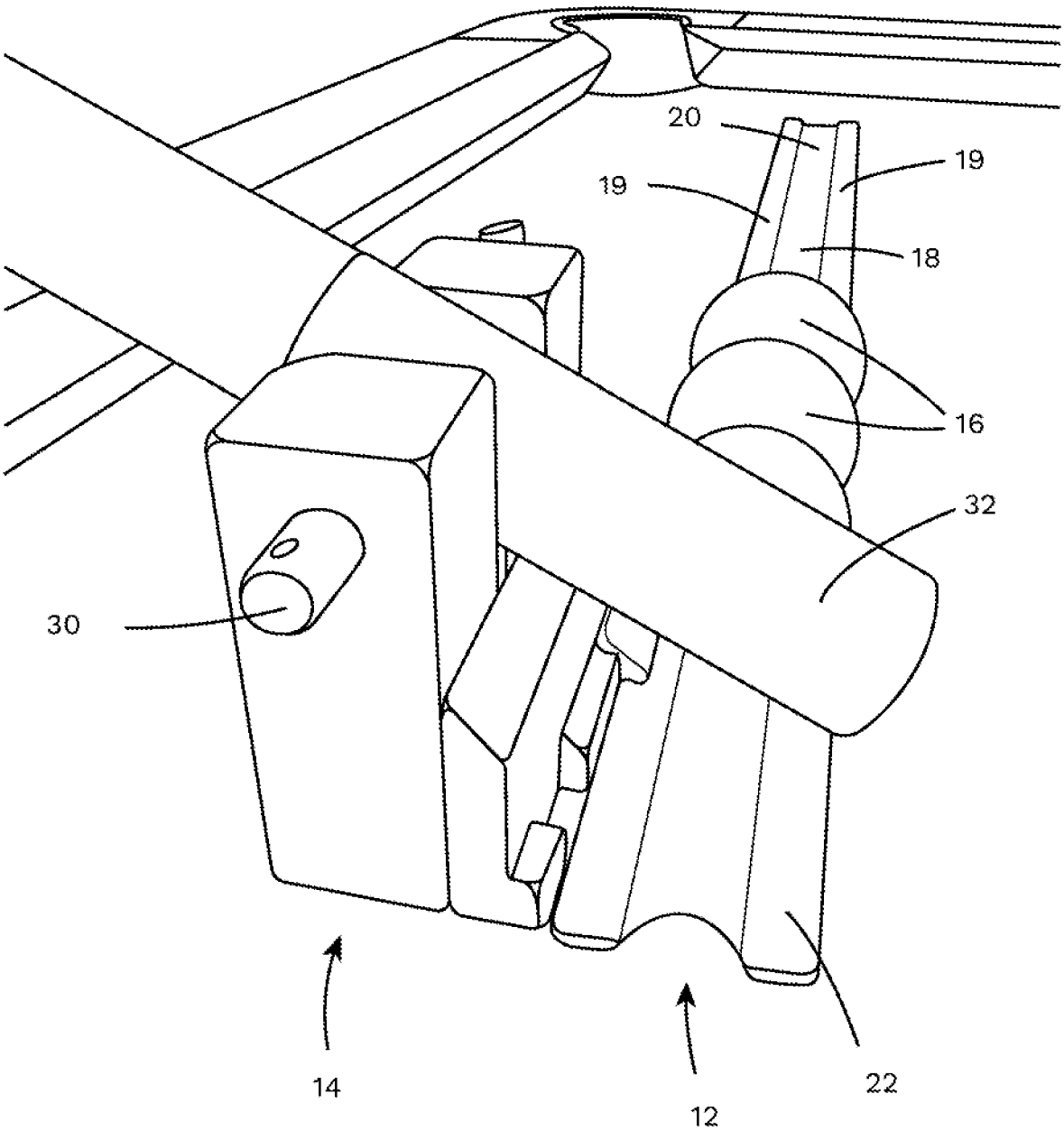
FIG. 3 is a front elevation view of a dispensing mechanism of the dispensing device of FIG. 1.
Figure 4:
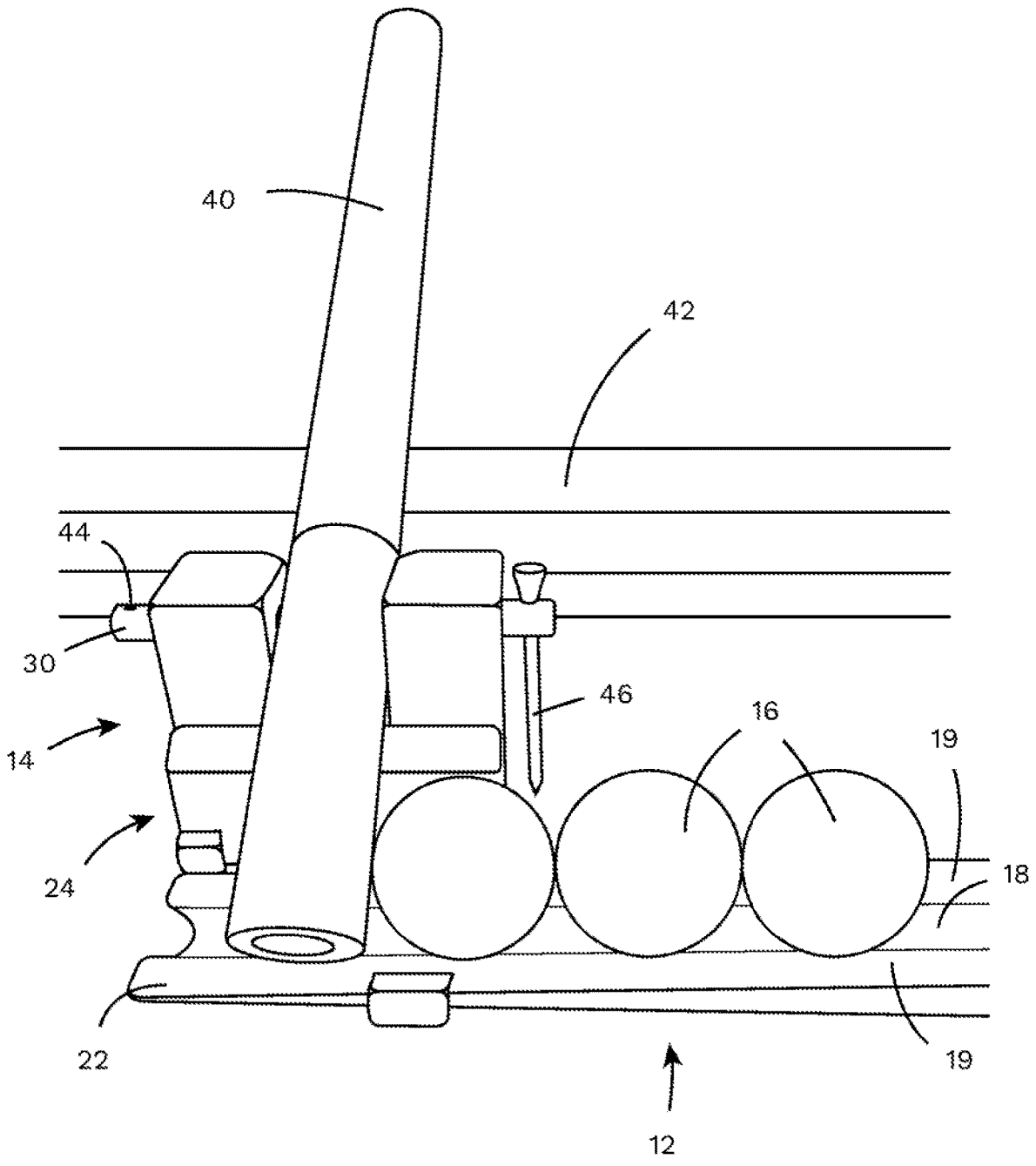
FIG. 4 is a right side elevation view of the dispensing mechanism of FIG. 3.
Figure 5:
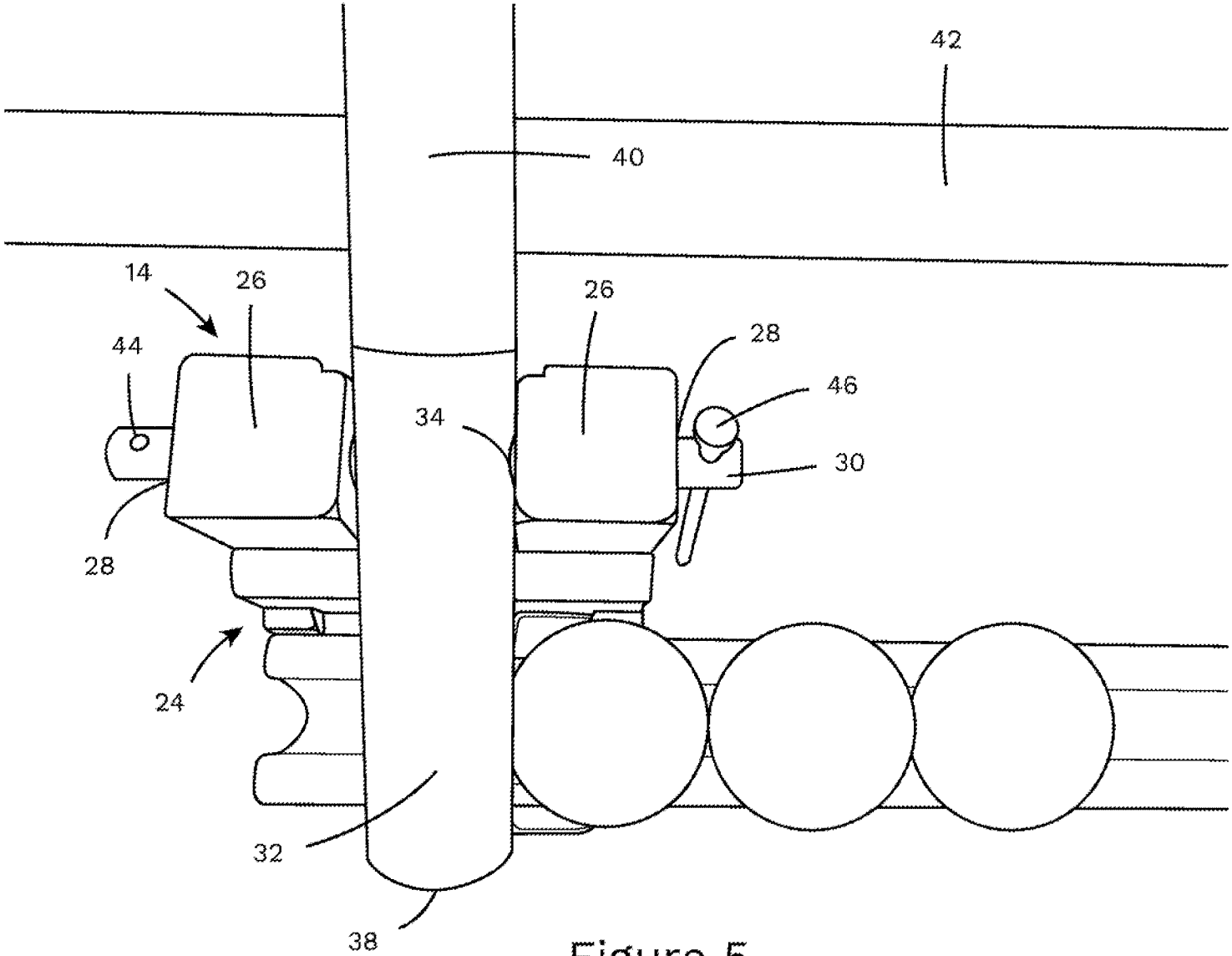
FIG. 5 is a top plan view of the dispensing mechanism of FIG. 3.
Figure 6:
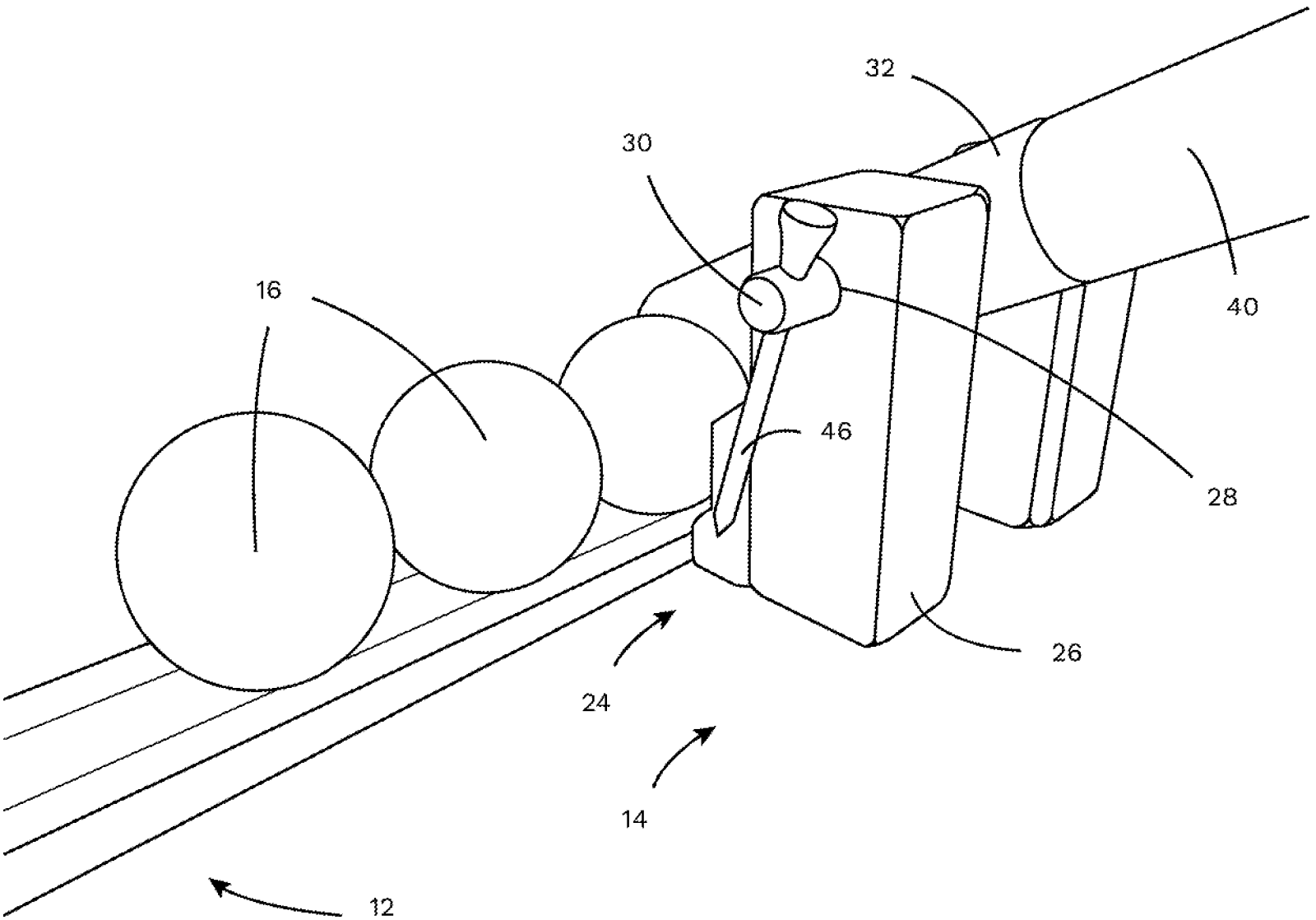
FIG. 6 is a left side elevation view of the dispensing mechanism of FIG. 3.

The track 12 is formed of a suitable material, such as a metal, wood or plastic and is capable of holding a number of billiard or pool balls 16 thereon. The balls 16 in the illustrated exemplary embodiment are located in a line along channel 18 formed along the track 12 between a pair of opposed upwardly extending ridges 19. The depth of the channel 18 is such that the balls 16 are supported by the inner edges of the ridges 19 and thus allowed to freely roll along track 12 over the channel 18. While the illustrated exemplary embodiment in FIG. 3 shows the ridges as having generally rectangular cross-sectional shapes, the ridges 19 can be formed to have different cross-sectional shapes with upper surfaces 17 the conform more closely to the spherical shape of the balls 16, such as angled or curved upper surfaces 17. Further, the depth of the channel 18 can be varied, such as by altering the height of the ridges 19 with regard to the remainder of the track 12 or by placing an insert (not shown) within the channel 18 between the ridges 19 to accommodate balls 16 of different diameters to enable the balls 12 to roll freely with respect to the track 12 or to provide a specified amount of resistance/friction against the balls 16 to control the speed at which the balls 16 move along the track 12. This can allow the balls 16 to move at a consistent speed along the track 12, or to move faster along different portions of the track 12, in order to enable the device 10 to dispense the balls 16 varying distances from the track 12.

In order to provide the motive force to move the balls 16 along the track 12, a number of different motive mechanisms 19 can be utilized, including mechanical and electrical motive mechanisms (not shown) to engage and urge the balls 16 along the channel 18 of the track 12. In the illustrated exemplary embodiment, the track 12 employs a gravity-operated motive mechanism 19A in which the track 12 includes a base 21 that is slightly tapered or angled in cross-section, having a high back end 20 and a low forward end 22, and on which the ridges 19 are positioned to define the channel 18 over the base 21. The angle of the base 21 of the track 12 enables the balls 16 positioned on the ridges 19 to be constantly urged from the back end 20 towards the forward end 22 under the influence of gravity. In addition to the angled base 21 other biasing mechanisms 19 can be used with the base 21, such as having a spring-biased mechanism (not shown) engaging the balls 18 on the angled base 21.

Adjacent the front end 22, the dispensing mechanism 14 is attached to the base 21 of the track 12. The dispensing mechanism 14 can take many forms to selectively dispense the balls 18 from the track 12, such as various mechanical or electrical mechanisms. Further, the component parts of the dispensing mechanism 14 can be formed from any suitable material, such as a metal, a plastic or a wood, among others.

In the illustrated exemplary embodiment shown in FIGS. 1 and 6-11, the dispensing mechanism 14 includes a platform 24 including a pair of support braces 26 extending upwardly from the platform 24. The braces 26 each include an aperture 28 therein that each receive a shaft 30 therethrough. Between the braces 26, the shaft 30 supports a pivot arm 32 that has an opening 34 through which the shaft 30 extends. In an alternative embodiment, a pair of washers or bearings (not shown) are located on each side of the arm 32 between the braces 30 and the arm 32 to facilitate the rotation of the shaft 30 and/or arm 32 relative to the braces 26.

Figure 7:
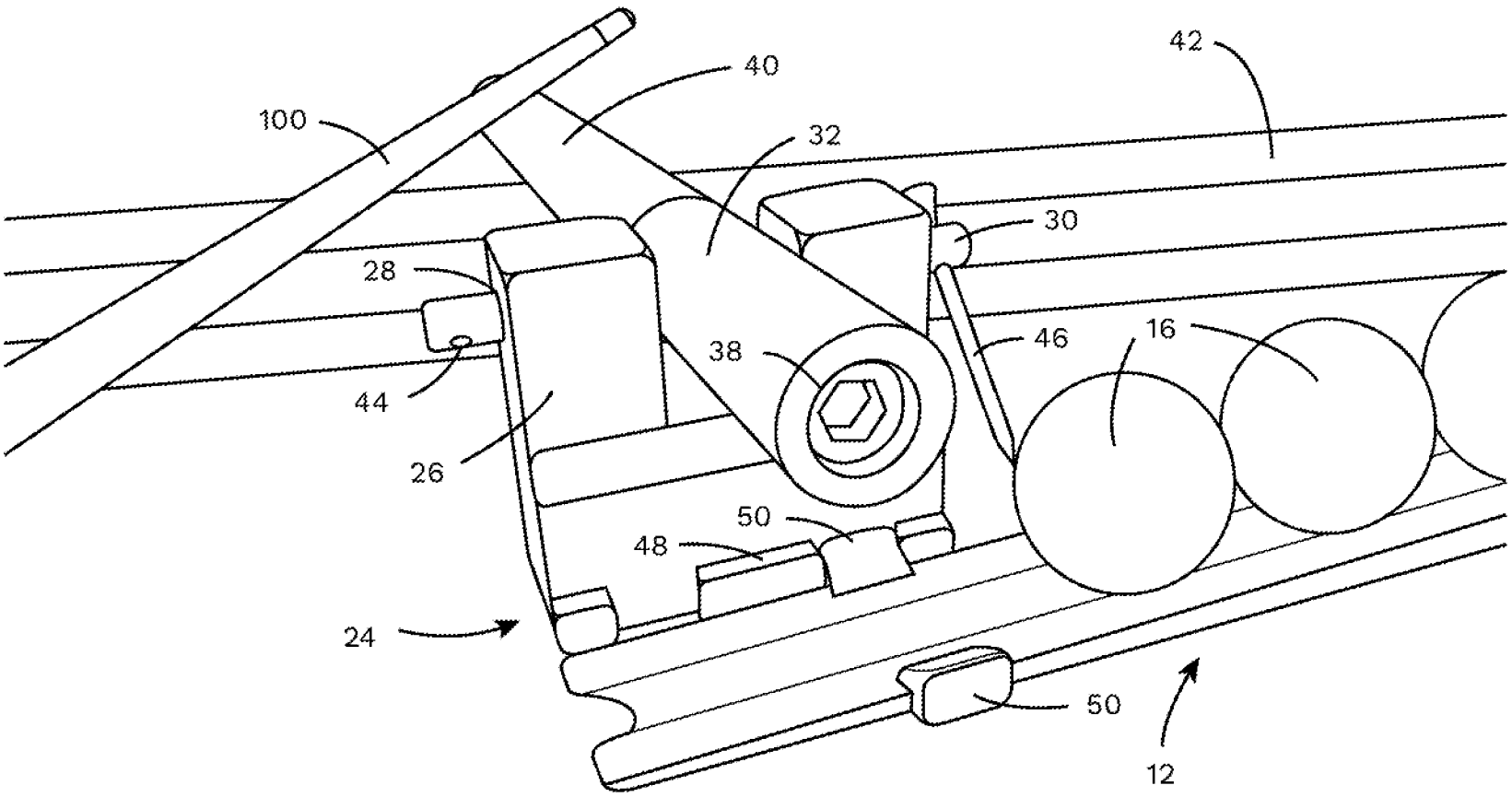
FIG. 7 is a right side elevation view of the dispensing mechanism of FIG. 3 in a dispensing position.
Figure 8:
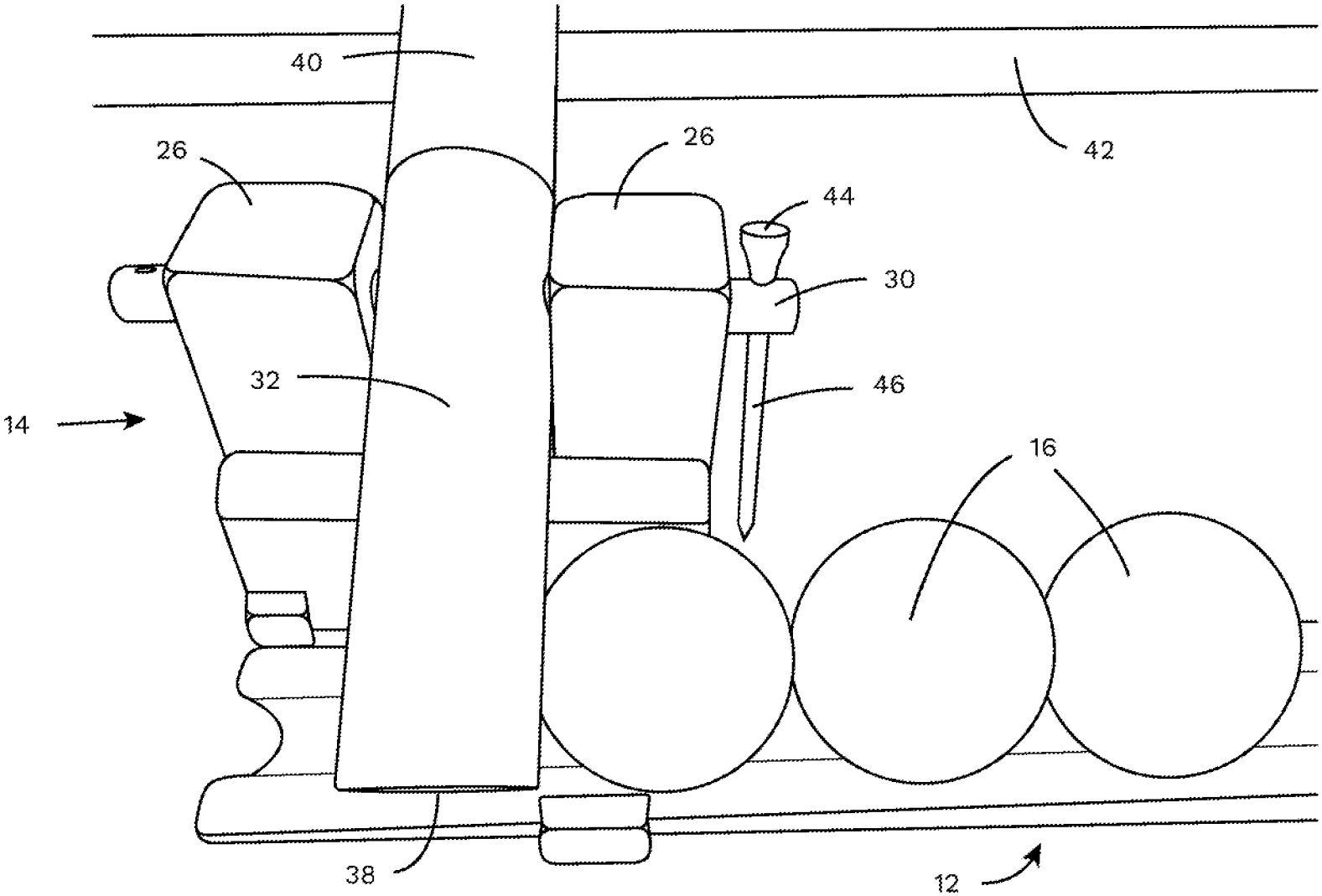
FIG. 8 is a top plan view of the dispensing mechanism of FIG. 3.

Looking now at FIGS. 7 and 8, the arm 32 includes a plug 38 disposed on the end of the arm 32 adjacent the track 12. The plug 38 is a weighted element having a sufficient mass to pivot the arm 32 and shaft 30 downwardly towards the track 12 and to enable the arm 32 to obstruct the path of the balls 16 from rolling off of the track 12, as shown in FIG. 7, which can be located on the exterior or within the interior of the arm 32. While the illustrated exemplary embodiment shows the plug 38 disposed within the end of the arm 32, the plug 38 can have many alternative forms and positions, so long as the location and mass of the plug 38 on the arm 32 is sufficient to bias the arm 32 downwardly to obstruct the forward end 22 of the base 21 of the track 12.

Opposite the plug 38, the illustrated exemplary embodiment of the arm 32 includes a pad 40 or other engagement member disposed around the arm 32 and extending approximately between the braces 26 and the end of the arm 32 opposite the plug 38. The pad 40 provides a location on the arm 32 where an individual can engage and push downwardly on the arm 32 to counteract the force of the plug 38 and raise the arm 32 away from the obstructing position in front of the forward end 22 of the base 21 of the track 12, as shown in FIG. 8. The length of the arm 32 and the pad 40 can be selected as desired, but in an exemplary embodiment the braces 26 have a specified height such that when the base 21 is disposed on a pool table playing surface (not shown), the movement of the arm 32 for operation of the device 10 enables the pad 40 to move to a location where when the pad 40 contacts a side rail 42 of a pool table or billiards table, the arm 32 properly positions the end of the arm 32 including the plug 38 away from the track 12 to enable a ball 16 to be dispensed from the track 12. Further, the length of the arm 32 is optionally selected to enable the arm 32 to contact the side rail 42 when in use to limit the movement of the arm 32 and avoid the arm 32 and plug 38 from being moved too far from the track 12, to avoid too many balls from being dispensed from the device 10.

Figure 9:
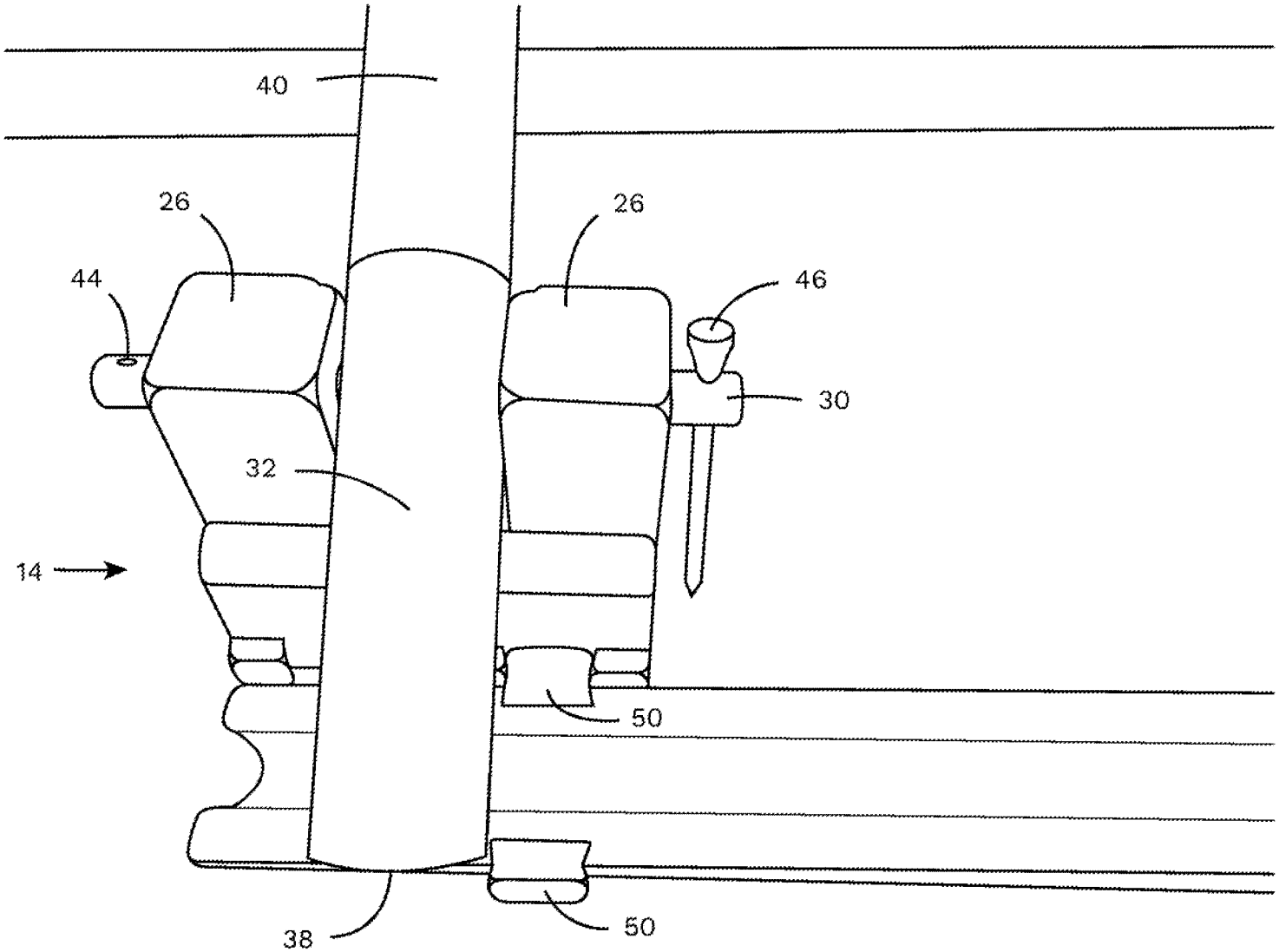
FIG. 9 is a top plan view of the unloaded dispensing device of FIG. 1.
Figure 10:
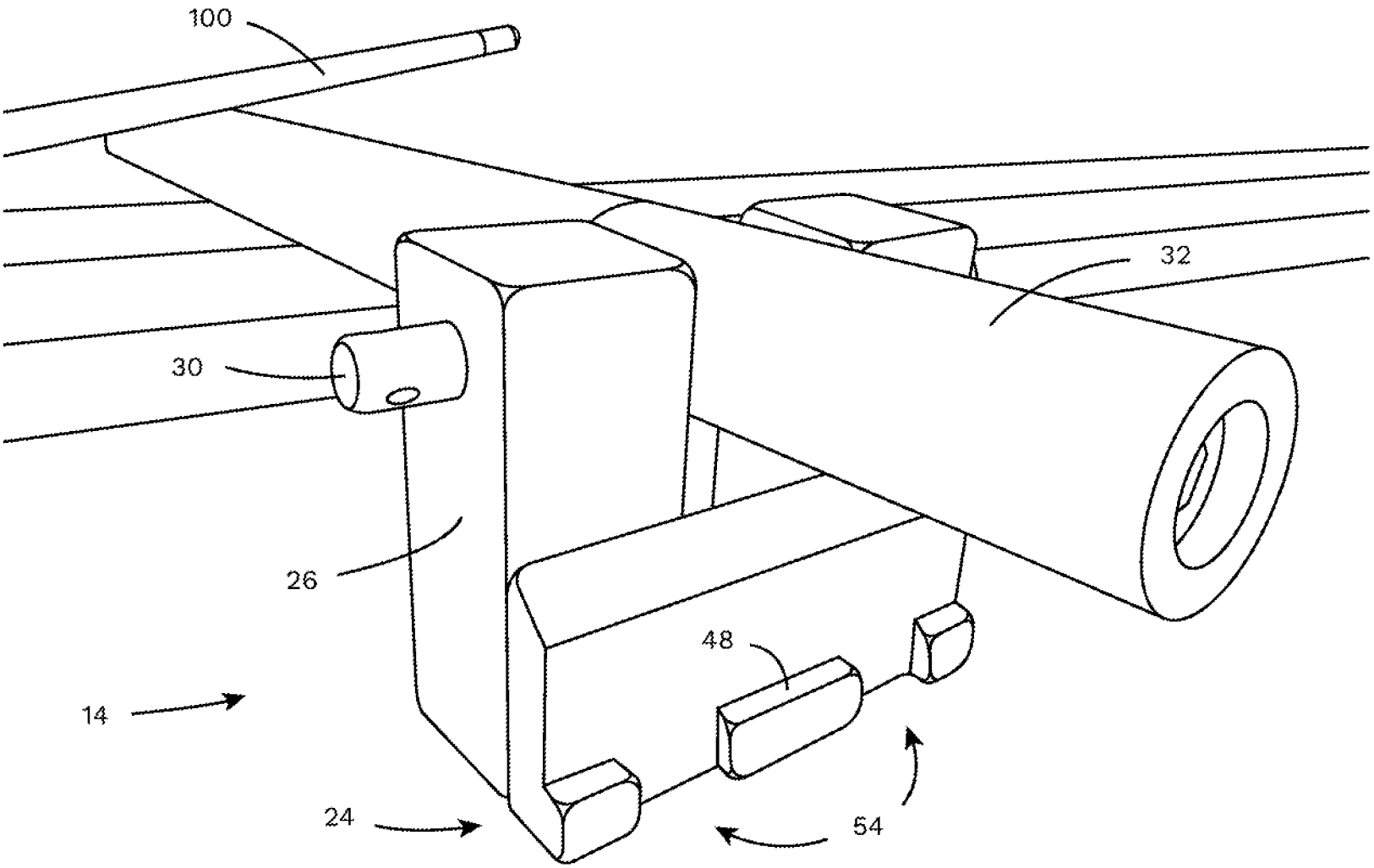
FIG. 10 is a front elevation view of the dispensing mechanism of FIG. 3 in a first configuration.
Figure 11:
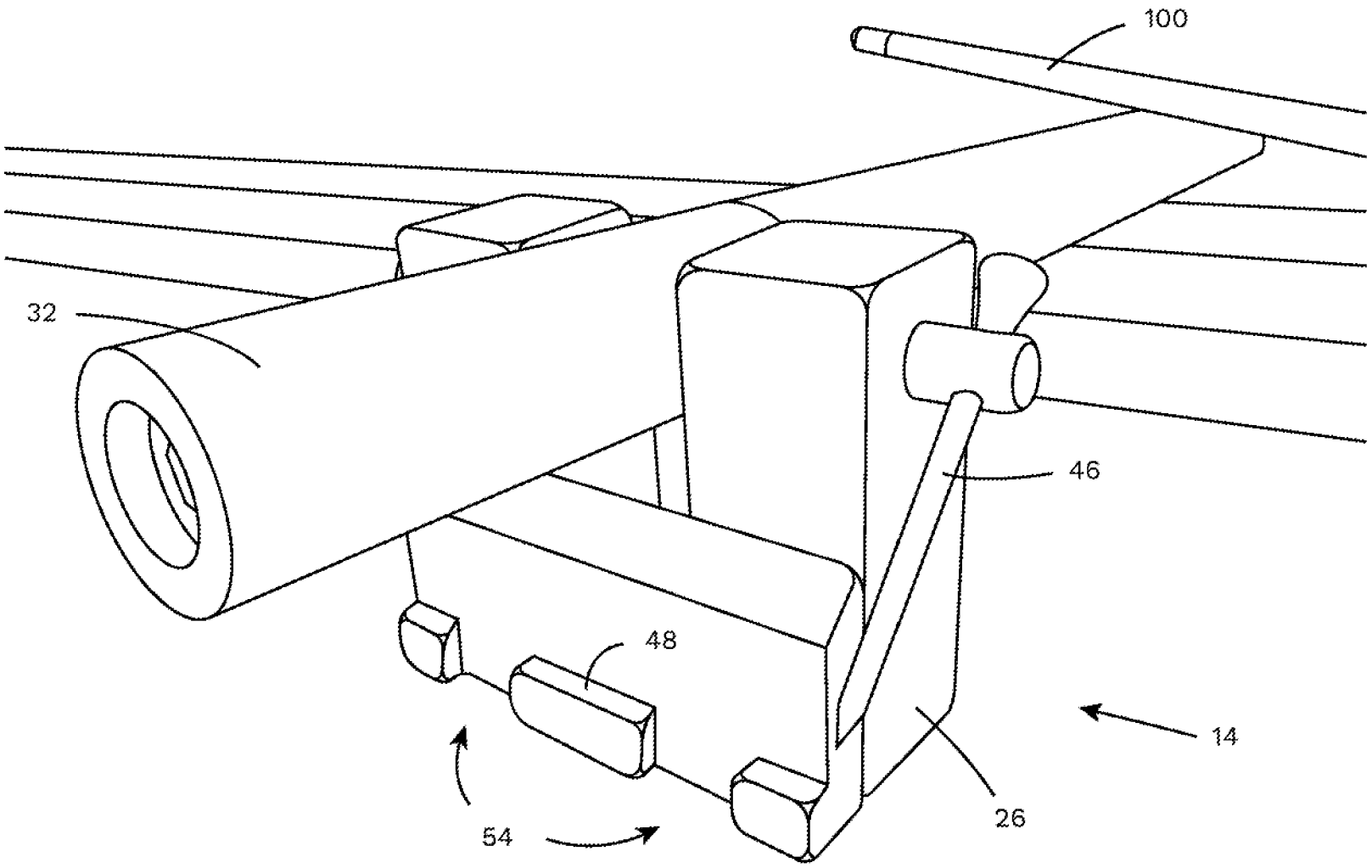
FIG. 11 is a front elevation view of the dispensing mechanism of FIG. 3 in a second configuration.

To enable the dispensing mechanism 14 to limit a single or other specified number of balls 16 to be dispensed from the track 12 when the arm 32 is moved, in the illustrated exemplary embodiment the shaft 30 includes a bore 44 adjacent each end of the shaft 30. The bore 44 receives a stop 46 therein that extends outwardly from the shaft 30 in an offset angular position with regard to the arm 32, such as a generally vertical direction when the arm 32 obstructs the track 12, as shown in FIGS. 7-9. When the arm 32 is moved to displace the plug 38 from obstructing the forward end 22 of the track 12, the movement of the arm 32 simultaneously moves the shaft 30 to rotate the stop 46 upwardly between the first ball 16 on the track 12 and the ball 16 immediately adjacent the first ball 16. In the illustrated exemplary embodiment, the stop 46 includes a tapered end that facilitates the insertion of the stop between the adjacent balls 16, though other configurations for the stop 46 can be employed. Thus, as the arm 32/plug 38 is moved away from the track 12 to enable the first ball 16 to roll off the track 12, the stop 46 is positioned to obstruct the adjacent ball 16 on the track 12, preventing the adjacent ball 16 from moving along the track 12. When the arm 32 is released and the arm 32/plug 38 move back to obstruct the track 12, the stop 46 is displaced from its position obstructing the adjacent ball 16, which consequently moves or is moved forward along the track 12 to contact the arm 32/plug 38. In this position the adjacent ball 16 becomes the first ball 16 to be dispensed when the dispensing mechanism 14/arm 32 is subsequently activated or moved.

Looking now at FIGS. 7-11, the platform 24 of the dispensing mechanism 14 includes an attachment member 48. In the exemplary illustrated embodiment, the attachment member 48 is formed as a number of notches 54 located in the platform 24 that are releasably engageable with tabs 50 formed on the track 12. The engagement of the tab 50 with the notch 54 secures the dispensing mechanism 14 to the track 12 at the proper position for dispensing a single ball 16 off of the track 12 when the dispensing mechanism 14 is operated. The tabs 50 can also be disposed on opposed sides of the track 12 and multiple notches can be formed in the platform 24 such that the platform 24 can be secured to the track 12 at different positions, enabling the device 10 to dispense different numbers of balls 16 from the track 12. Further, the flexibility of the securing of the attachment member 48 to attach the platform 24 to the track 12 enables the dispensing mechanism 14 to be engaged with each side of the track 12 to provide different options with regard to the positioning of the dispensing mechanism 14 to allow the desired shot to be repeatedly set up using the device 10.

In an alternative embodiment, the tab 50 can be formed on the platform 24 and the notches 54 can be located on the track 12. Further, the tab 50 can be disposed on an arm (not shown) pivotally secured to the platform 24. The tab 50 is spaced from the pivot point (not shown) of the arm to the platform 24 to enable the tab 50 to be moved to attach the platform 24 to the track 12 in different locations.

Figure 12:
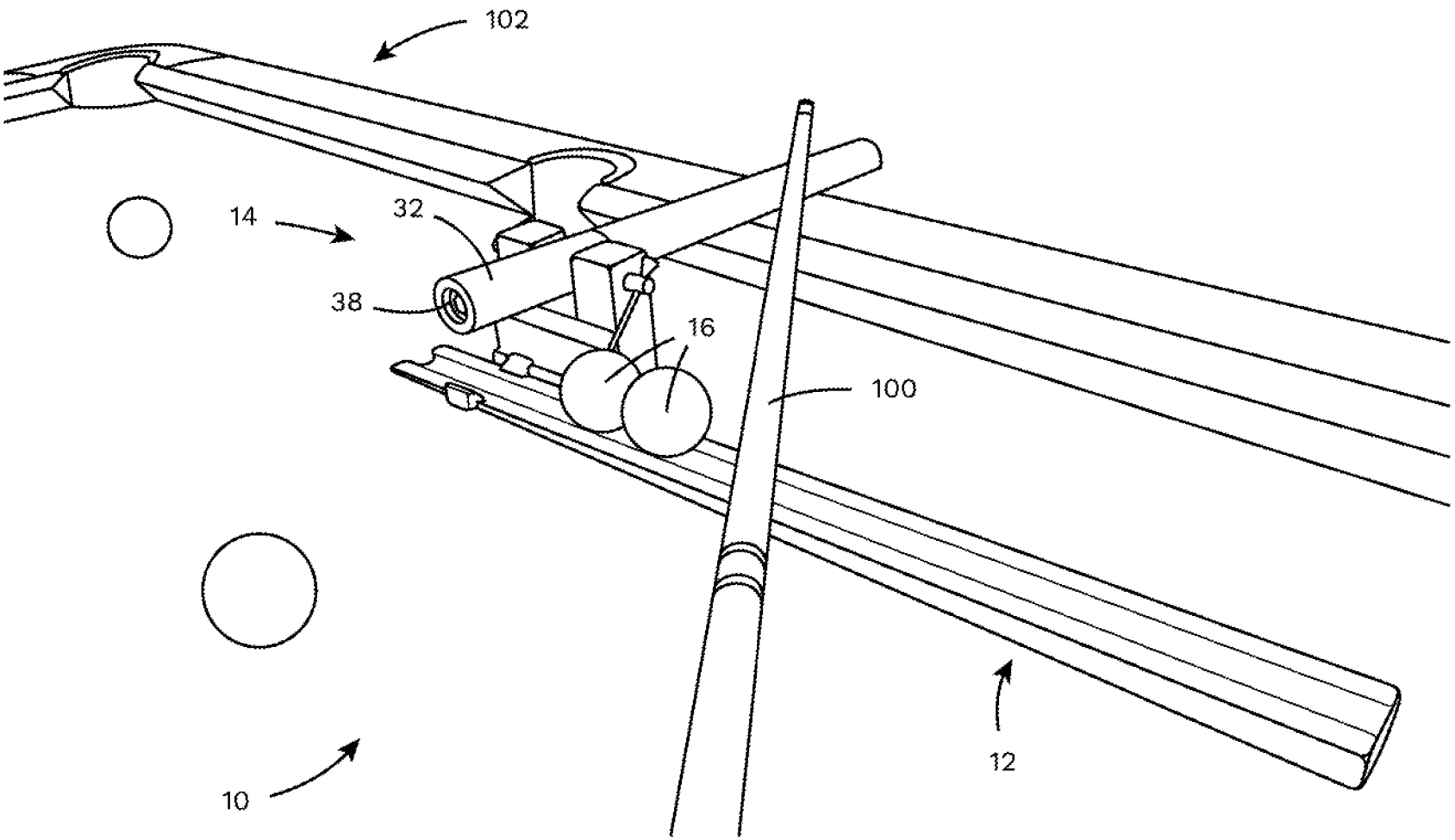
FIG. 12 is a perspective view illustrating the operation of the dispensing mechanism on the dispensing device.

In operation, the dispensing mechanism 14 is attached to the track 12 on the desired side of the track 12 to allow for the balls 16 dispensed from the device 10 to move to the desired location for the shot to be taken and the device 10 is placed on the playing surface of a pool table 102. The balls 16 are then positioned on the track 12 and the arm 32 of the dispensing mechanism 14 is operated, such as by contacting the arm 32 with a pool cue 100 opposite the plug 38 as shown in FIG. 12, to dispense a single ball 16 from the track 12 onto the table surface to take the desired shot. Once the first shot has been completed, the arm 32 can be activated again to dispense one or more additional balls 16 from the track 12 to take additional shots.

In addition, the device 10 not only saves the users time, but also the energy of the user. The goal of the device 10 is not solely to shoot more balls or to shoot balls more quickly but to assist the user so they can use their time and energy more efficiently and effectively. Pool tables don't have marks on the table playing surface so it can be difficult to repeatedly and accurately place a ball 16 in the same spot. Also, the user doesn't need to remember where the ball 16 was supposed to be placed when using the device 10, as the device 10 can place the ball 16 where needed when activated.

The person views the shot from a standing position. The person shoots the shot in a bent-over-the-table position. Placing the object/target ball without the device 10 might only require the user to bend over and reach across the table. However, often times the physical action performed in order to place the object/target ball 16 in the desired location can hinder or distract the user from shooting a productive shot.

The simple act of placing the object/target ball 16 might seem relatively easy, but when multiplied it can become taxing on the body and distracting to the mind. When the user does finally make it to the bent-over-the-table position to shoot the shot, all of the standing up and bending over can make the user a little dizzy detracting from executing a productive shot. Also, when the user does finally make it to the bent-over-the-table position, they might be thinking about where the ball 16 is placed instead of focusing on the mechanics of their shot/stroke. As such, the device 10 allows the user to focus more physical and mental energy on shooting the shot and less on setting up the shot.

Various other embodiments of the present invention are contemplated as being within the scope of the filed claims particularly pointing out and distinctly claiming the subject matter regarded as the invention.

I claim:

1. A ball dispensing device comprising:

a) a track adapted to be placed on a table playing surface and to hold a number of balls thereon; and b) a dispensing mechanism attached to the track to selectively dispense balls from the track, wherein the dispensing device comprises:

i) a platform operably connected to the track;

ii) a pivot arm operably connected to the platform iii) a rotating shaft disposed on the platform and to which the pivot arm is connected; and iv) a stop disposed on the shaft.

2. The ball dispensing device of claim 1 wherein the stop is spaced from the pivot arm.

3. The ball dispensing device of claim 1 wherein the stop is disposed on the shaft in a position angularly offset from the pivot arm.

4. A method for selectively dispensing balls onto a surface, the method comprising the steps of:

a) providing a ball dispensing device comprising:

i) a track adapted to hold a number of balls thereon; and ii) a dispensing mechanism attached to the track adjacent a dispensing end of the track to selectively dispense balls from the track;

b) placing the dispensing device on a support surface;

c) placing a number of balls on the track of the dispensing device; and d) operating the dispensing mechanism to selectively dispense the balls from the track, wherein the dispensing mechanism includes a stop to separate the ball to be dispensed from the remaining balls on the track, and wherein the step of operating the dispensing mechanism comprises:

a) dispensing a single ball from the track; and b) retaining remaining balls on the track with the stop.

* * * * *